US005408046A

United States Patent [19]

Vandeventer

[11] Patent Number: 5,408,046

[45] Date of Patent: Apr. 18, 1995

[54] SAFETY COVER FOR ELECTRICAL OUTLET

[76] Inventor: Jerry L. Vandeventer, 8766 Headley Dr., Sterling Heights, Mich. 48314

[21] Appl. No.: 74,203

[22] Filed: Jun. 9, 1993

[51] Int. Cl.[6] ..... H01R 13/44

[52] U.S. Cl. ..... 174/67; 439/147

[58] Field of Search ..... 174/67; 220/242, 375; 439/135, 136, 147

[56] References Cited

U.S. PATENT DOCUMENTS

| | | | |
|---|---|---|---|
| 2,878,456 | 3/1959 | Cormier | 439/142 |
| 3,067,402 | 12/1962 | Thaw | 174/67 X |
| 3,363,216 | 1/1968 | Benedetto | 439/147 |
| 3,601,757 | 8/1971 | Gober | 439/147 |
| 3,857,505 | 12/1974 | Mumford et al. | 215/220 |
| 3,955,870 | 5/1976 | Wasserman | 439/144 |
| 4,076,360 | 2/1978 | Kahera | 439/147 |
| 4,531,800 | 7/1985 | Avener | 439/373 |
| 4,603,932 | 8/1986 | Heverly | 439/147 |
| 4,618,200 | 10/1986 | Roberts et al. | 439/367 |
| 4,671,587 | 6/1987 | Lerner et al. | 439/142 |
| 4,723,823 | 2/1988 | Pinkerton et al. | 439/136 |
| 4,981,439 | 1/1991 | Piedmont | 439/135 |

*Primary Examiner*—Leo P. Picard
*Assistant Examiner*—David Tone
*Attorney, Agent, or Firm*—Howard & Howard

[57] ABSTRACT

A safety cover for use on electrical outlets includes a cap member which is releasably secured to a cowl member which encircles the electrical outlet. The cap member must be forced toward the electrical outlet and rotated to remove the cap from the cowl. A slot in the cowl wall allows passage of a plug cord while the cap is received on the cowl. Thus, the cap and cowl combination enclose the electrical outlet when a plug is received in the outlet, or when no plug is received in the outlet. Several embodiments of the connection between the cowl and cap are disclosed.

20 Claims, 3 Drawing Sheets

SAFETY COVER FOR ELECTRICAL OUTLET

BACKGROUND OF THE INVENTION

The present invention relates generally to an apparatus for covering electrical outlets and, in particular, to an apparatus for preventing contact with an electrical outlet or an electrical plug inserted therein.

Many people receive electrical shocks when they inadvertently come into contact with the prongs of an electrical plug. This can occur when a plug is being inserted or removed from an electrical outlet, when a plug is sagging in the outlet such that a portion of the prongs are exposed, or when an object is inserted into the plug while a device is plugged into the outlet. Additionally, children could be exposed to electrical shock if they stick objects into electrical outlets, or when they contact the prongs of an engaged plug.

There are a number of devices currently available which cover the outlet plugs. These devices effectively cover an outlet but do not prevent contact with an installed plug, and do not prevent inadvertent contact with partially exposed prongs of an installed plug. Many of these devices can be pried from the outlet, thereby negating their effectiveness. Some devices require that a plug be twisted while being inserted into or removed from an outlet, but do not address the problem of children contacting an installed plug. Other devices cover an outlet while a plug is installed, but do not prevent access to the outlet when no plug is installed. Yet other devices cover an outlet while a plug is inserted or removed, but do not protect against a child playing with a plug which has been inserted.

U.S. Pat. No. 2,878,456 discloses a safety device which covers a plug when not in use, and provides guards which prevent fingers from accidentally coming into contact with the prongs of a plug while it is being inserted or removed from an outlet. This device may not always prevent removal of the plug.

U.S. Pat. No. 4,531,800 discloses a safety device which consists of collars located on the plug receptacle and a split cap which wraps around a plug such that the cap engages the collars to prevent access to the outlet while the plug is engaged. In this device, the plug cord passes through an opening that is aligned with the outlet. This cover may not effectively cover the outlet when no plug is inserted.

U.S. Pat. No. 4,603,932 discloses an electrical outlet cover which consists of a rectangular box that must be squeezed to remove it from its retaining plate. This device may somewhat be difficult to install and may provide some access to the outlet via slots in the bottom.

U.S. Pat. No. 4,671,587 discloses an outlet cover which must be twisted in order to be removed. The cover is not in use when a plug is engaged in the outlet, and thus does not prevent access to the plug prongs.

U.S. Pat. No. 4,981,439 discloses a safety cover which consists of cowls extending outward from the outlet thereby making it difficult for fingers to come into contact with the prongs of a plug while it is being inserted or removed. Caps which lock into place on the cowls prevent a child from accessing an unused outlet. The device does not provide any protection to an inserted plug.

SUMMARY OF THE INVENTION

The present invention provides a safety cover for an electrical outlet which includes a cover plate made of a non-conductive, flame-retardant material and having at least one opening formed therein for access to an electrical receptacle when the cover plate is installed on an electrical outlet. Extending from the cover plate is at least one generally tubular cowl having an open end. A slot is formed in a wall of the cowl extending from the open end toward the cover plate for receiving an electrical cord connected to an electrical plug to be plugged into the outlet. The cowl and a cap for closing the open end of the cowl together provide a "child-proof" or child resistant fastener, whereby the cap can be removed only by simultaneously pushing and twisting. Thus, the safety cover prevents access to the outlet without removal of the cover.

Since the plug cord extends through the slot in the side wall, and since the cap closes off that slot, access is prevented to the electrical outlet, either when a plug is received in the outlet, or when no plug is received in the outlet. Moreover, since the slot extends through the wall of the cowl along an axis which is not aligned with the axis into the electrical outlet, it would be difficult for one to manipulate any item through the slot and gain access to the interior of the plug receptacle.

Several embodiments are disclosed, including one embodiment for use with ground fault interrupter plugs. In general, all of the embodiments share the feature that the cap member must be pushed toward the receptacle and turned to remove the cap member.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
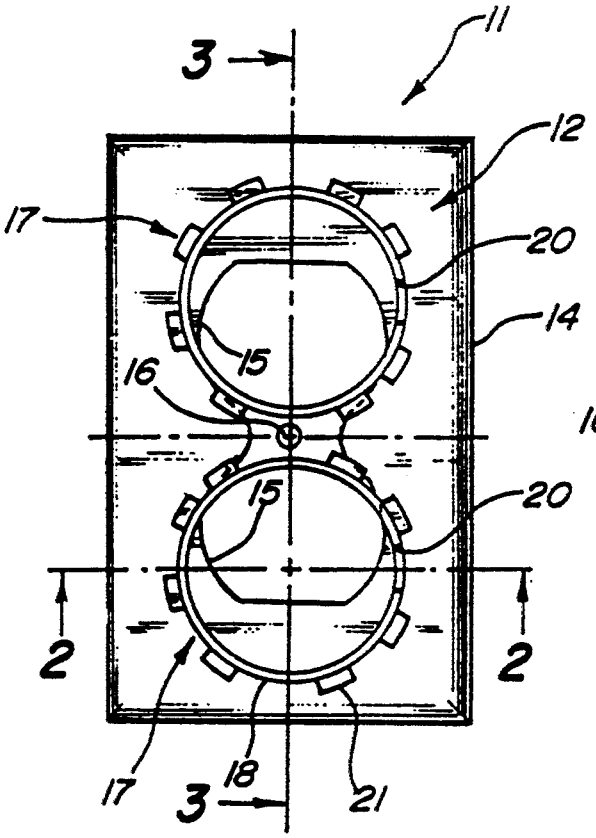
FIG. 1 is a front elevation view of a cover plate of a safety cover in accordance with the present invention.
Figure 3:
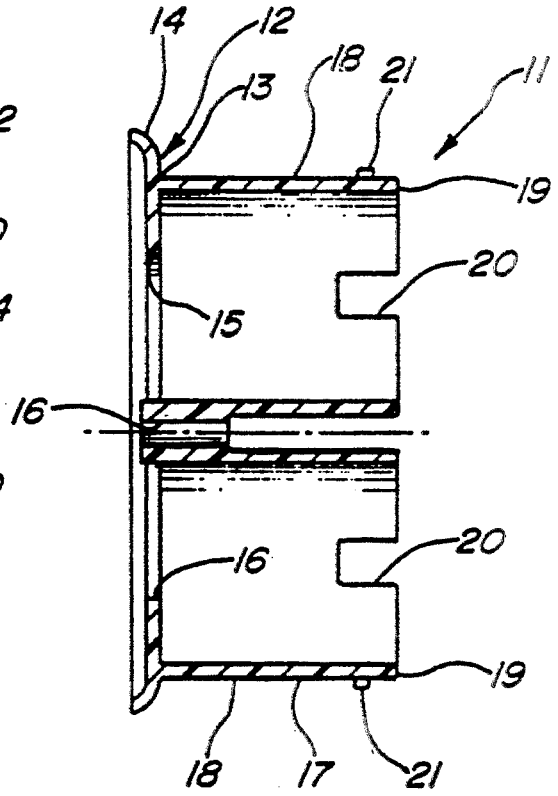
FIG. 3 is a cross-sectional view of the cover plate taken along the line 3—3 in the FIG. 1.
Figure 2:
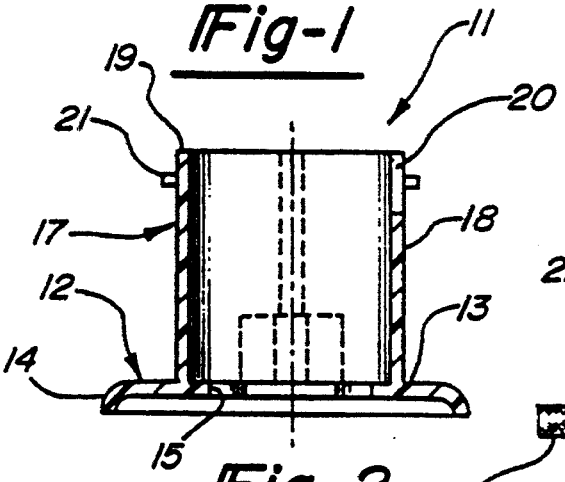
FIG. 2 is cross-sectional view of the cover plate taken along the line 2—2 in the FIG. 1.

There is shown in the FIGS. 1 through 3 a safety cover 11 in accordance with the present invention. The cover 11 includes a generally rectangular cover plate 12 having a generally planar central portion 13 surrounded on a periphery thereof by a rearwardly extending curved edge portion 14. Formed in the central portion 13 is a pair of outlet apertures 15 and a mounting aperture 16. The plate 12 is intended to replace the typical electrical outlet cover plate. Therefore, the outlet apertures 15 are spaced apart and shaped to accept the extending receptacle portions of a typical duplex electrical outlet. The mounting aperture 16 is positioned between the outlet apertures 15 and dimensioned to accept a typical mounting screw which extends therethrough and threadably engages a threaded aperture in the electrical outlet. The exterior dimensions of the plate 12 and the curved edge portion 14 correspond to the typical outlet cover plate. Thus, the safety cover 11 according to the present invention can be installed on existing electrical outlets by removing the existing mounting screw and cover plate and attaching the safety cover 11 with the existing mounting screw.

Attached to and extending outwardly from a front surface of the plate 12 are a pair of cowls 17. Each of the cowls 17 is generally cylindrical in cross section and surrounds a corresponding one of the outlet apertures 15. Each cowl 17 includes a wall 18 which completely encircles the corresponding outlet aperture 15 and terminates in an outer edge 19 at an open outer end. Formed in the wall 18 is a generally longitudinally extending cord slot 20 which extends from the outer edge 19 inwardly toward the planar central portion 13. As will be explained below, the slot 20 is dimensioned to provide an exit for an electrical cord attached to a plug inserted into an electrical receptacle extending into the aperture 15. As shown in the FIG. 1, a plurality of radially outwardly extending locking shoulders 21 are formed on an exterior surface of the wall 18 adjacent the outer edge 19. These shoulders 21 provide a first portion of a fastener means which forms a well-known "childproof" closure.

Figure 4:
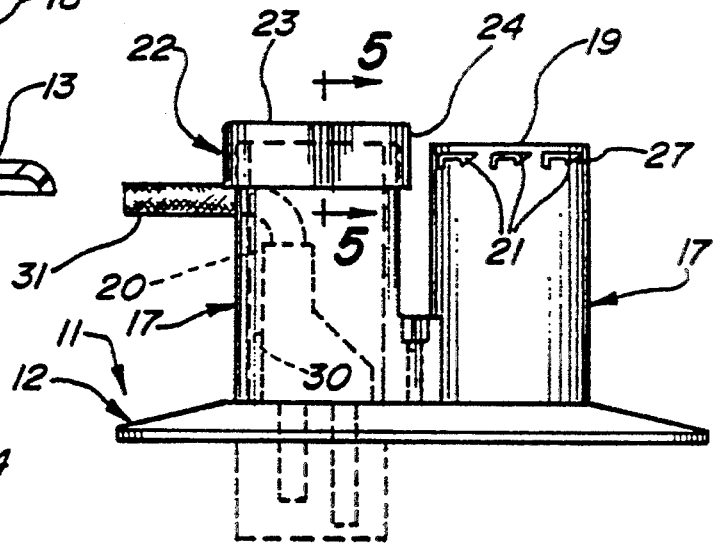
FIG. 4 is a left side elevation view of the cover plate shown in the FIG. 1 including a protective cap.
Figure 5:
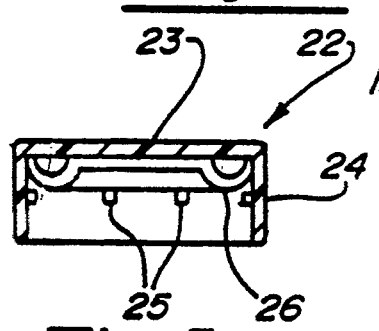
FIG. 5 is a cross-sectional view of the protective cap taken along the line 5—5 in the FIG. 4.
Figure 6:
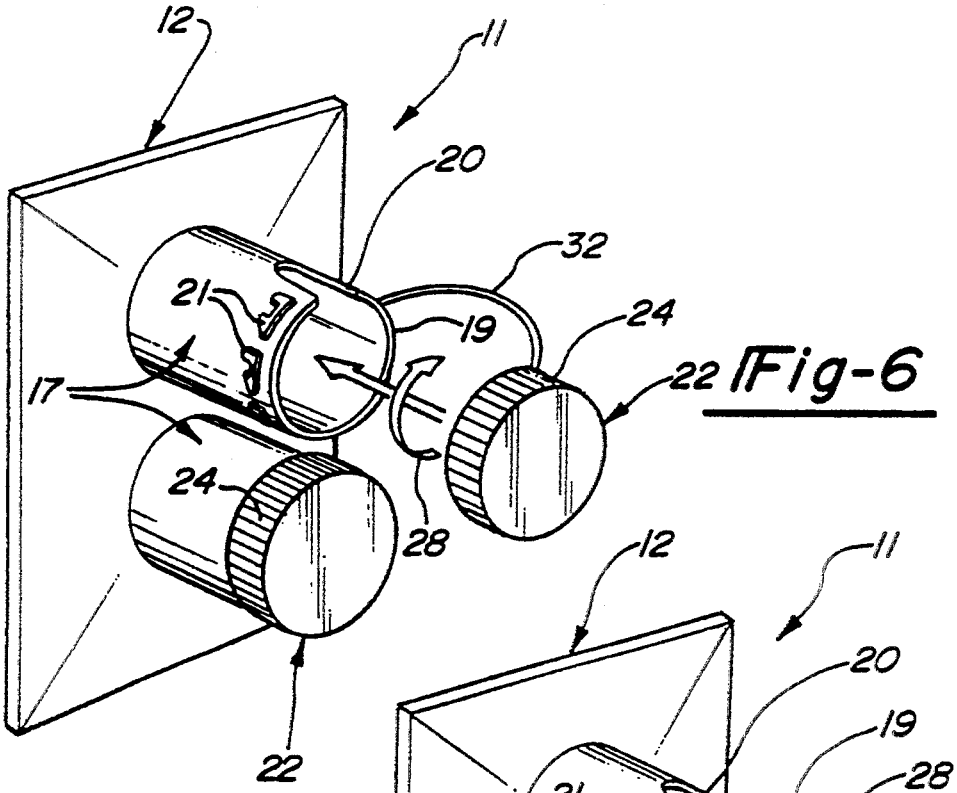
FIG. 6 is a perspective view of the cover plate and protective cap shown in the FIG. 4 with another protective cap to be installed.

As shown in the FIGS. 4 through 6, a pair of caps 22 are provided for closing the open end of each of the cowls 17. As best shown in the FIG. 5, the cap 22 is generally cup shaped with a generally planar circular end wall 23 having a longitudinally extending annular side wall 24 attached to a periphery thereof. The outer surface of the side wall 24 of the cap 22 can be formed with a suitable gripping means such as serrations which assist in applying the twisting force necessary to install and remove the cap 22. A plurality of radially inwardly extending tabs 25 are formed about an inner surface of the side wall 24 for engaging corresponding ones of the shoulders 21 formed on the cowl 17. A resilient annular spring means 26 is attached to an inner surface of the end wall 23. The spring means 26 engages the outer edge 19 of the cowl 17 such that when the cap 22 is placed on the open end of the cowl 17, the tabs 25 will be positioned between the shoulders 21 thereby permitting the cap 22 to be removed from the cowl 17. If pressure is applied to the end wall 23 of the cap 22 in a direction toward the cover plate 12, the spring means 26 will collapse sufficiently to permit each of the tabs 25 to engage a ramp portion 27 of a corresponding one of the shoulders 21. If the cap 22 is then rotated in a clockwise direction as shown by an arrow 28 in the FIG. 6, the tab 25 will travel along the ramp portion 27 further collapsing the spring means 26 until the tab 25 enters a recess 29 formed in the shoulder 21. If the external pressure is then removed from the cap 22, the spring means 26 will maintain the tabs 25 in the corresponding recesses 29 preventing removal of the cap 22 from the cowl 17 even if a counterclockwise twisting force is applied to the cap 22. As is the case with the typical childproof closure, inward pressure must be applied to the end wall 23 at the same time that a counterclockwise twisting force is applied to the sidewall 24 in order to force the tabs 25 from the corresponding recesses 29. The tabs 25 may then travel along the corresponding ramp portions 27 until the tabs 25 are located between adjacent pairs of the shoulders 21. The the cap 22 may then be removed from the cowl 17.

In the FIG. 4, there is shown in phantom an electrical plug 30 positioned inside one of the cowls 17 and engaging an electrical receptacle shown in phantom. An electrical cord 31 is attached to the plug 30 and extends through the slot 20 to an associated electrically powered device (not shown) such as a lamp, small appliance, etc. The cap 22 is lockingly attached to the cowl 17 and closes the open end of the cowl 17 as well as an open end of the slot 20. Therefore, objects and human fingers are prevented from entering the cowl 17. The plug 30 is thus secure in the electrical receptacle with which it is engaged. It should be understood that the cap 23 is only moved downwardly along the cowl 17 to such an extent that it will not crimp the cord 31. Rather, sufficient room is left such that the cord 31 can pass through the slot 20, and between the end of the cap 22. Further, as is shown, the slot 20 extends through the side wall along an axis which is not aligned with the axis of the receptacle 51.

The safety cover 11 and the caps 22 are formed of a suitable non-conductive, flame-retardant material such as plastic. Each of the cowls 17 and the associated cap 22 protects an individual electrical receptacle. Thus, the safety cover 11 can be formed with as few as one or as many cowls 17 as required to replace any electrical outlet cover plate. The cap 22 can be attached to the safety cover 11 by any suitable means such as a flexible connector 32 as shown in the FIG. 6. The connector 32 can have one end attached to the outer surface of the cap 22 and an opposite end attached to an outer surface of the cowl 17 or an outer surface of the cover plate 12. The connector 32 can be, for example, a plastic strap or a chain.

Figure 7:
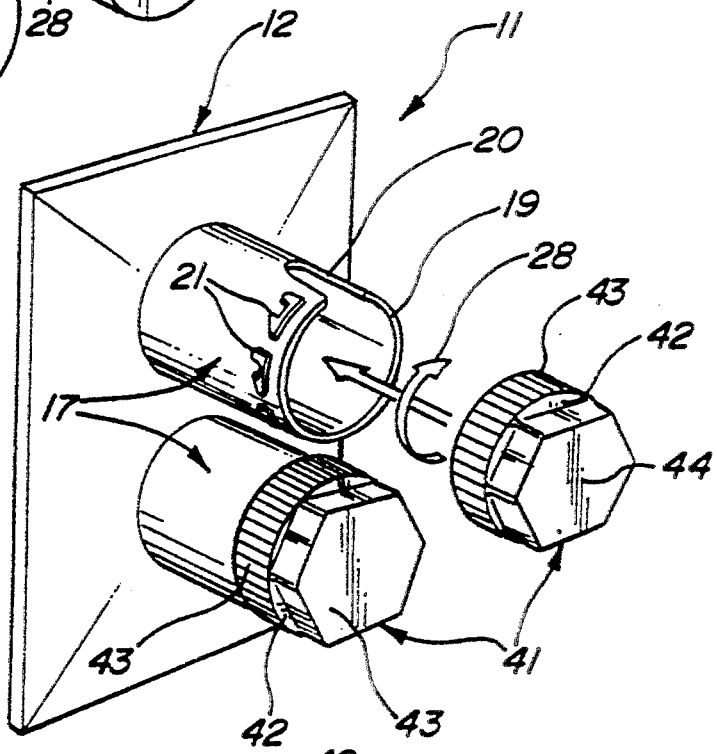
FIG. 7 is a perspective view similar to the FIG. 6 showing the cover plate with protective caps according to an alternate embodiment.
Figure 8:
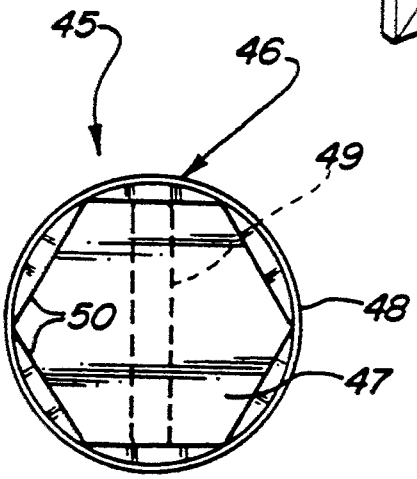
FIG. 8 is a rear elevation view of a tool for installing and removing the protective caps shown in the FIG. 7.
Figure 9:
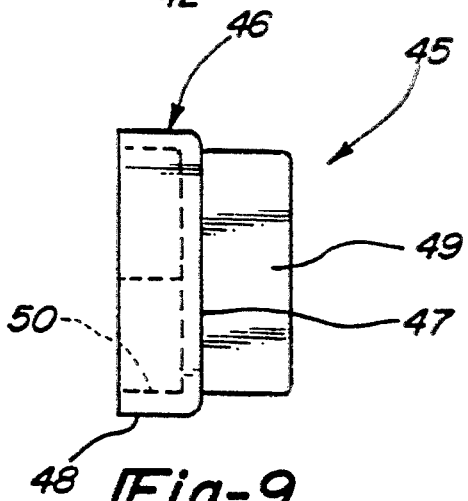
FIG. 9 is side elevation view of the tool shown in the FIG. 8.

There is shown in the FIG. 7 an alternate embodiment of the cap 22. A pair of caps 41 each have an end wall 42 similar to the end wall 23 and a side wall 43 similar to the side wall 24. The caps 41 lockingly attach to the cowls 17 in the same manner as the caps 22. As stated above, the outer surface of the side wall 24 of the cap 22 can be formed within a suitable gripping means such as serrations which assist in applying the twisting force necessary to install and remove the cap 22. However, the cap 41 has a boss 44 formed on an outer surface of the end wall 42. The boss 44 extends outwardly along a longitudinal axis of the cap 41 and has a polygonal cross section such as the hexagonal shape shown in the FIG. 7. There is shown in the FIGS. 8 and 9, a tool 45 having a generally cup shaped body 46 with a generally planar circular end wall 47 having attached at its periphery an annular side wall 48. Extending outwardly from an outer surface of the end wall 47 is a handle 49 in the form of a flange or tab. An inner surface of the sidewall 48 forms a recess 50 shaped to correspond to the cross-sectional shape of the boss 44. Thus, the tool 45 can be installed with the recess 50 engaging the boss 44 whereby the handle 49 can be grasped between the thumb and forefinger for applying force in a longitudinal direction to the cap 41 and the twisting force necessary to install and remove the cap 41.

Figure 10:
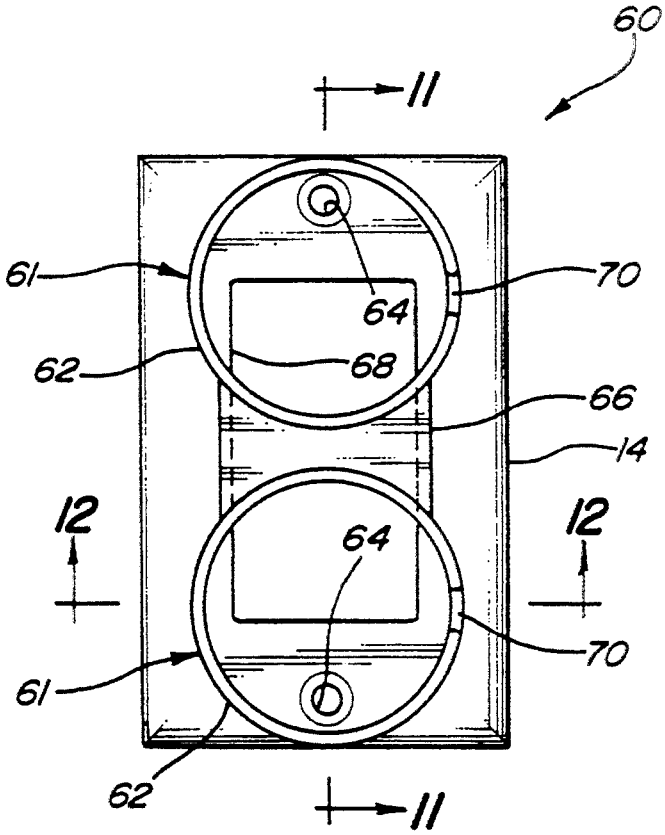
FIG. 10 is a front elevational view of a second embodiment safety cover.

FIG. 10 shows yet another embodiment 60 of a safety plug cover, which is particularly useful for use with a ground fault interrupter plug. Cowls 61 have cylindrical side walls 62 extending outwardly from the face of the cover 60. Fastener openings 64 are formed at the ends of the cover 60, and would be attached to the screw openings at the end of standard outlets. A wall 66 extends in between the cowls 61, and an opening 68 is formed to receive and pass over the typical ground fault interrupter plug member allowing access to "test" and/or "reset" buttons. Cord slots 70 are formed in side wall 62.

Figure 11:
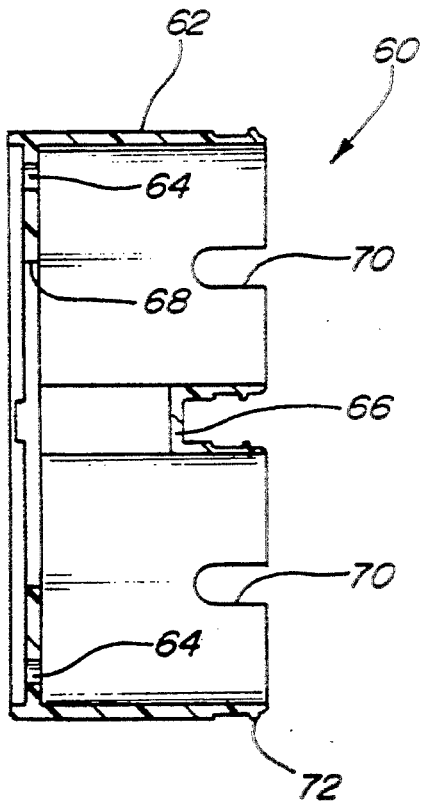
FIG. 11 is a cross-sectional view along line 11—11 as shown in FIG. 10.
Figure 12:
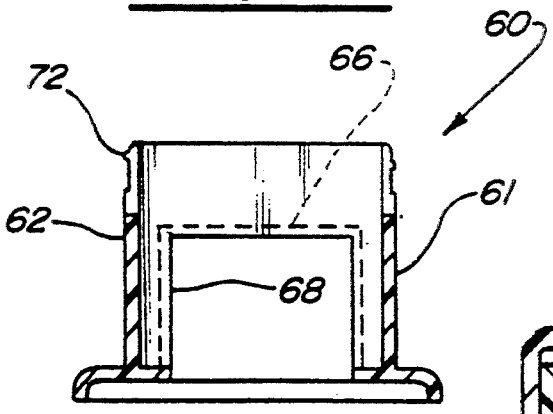
FIG. 12 is a cross-sectional view along line 12—12 as shown in FIG. 10.

As shown in FIG. 11, the wall 66 does not extend upwardly to the same extent as the cowl 62. Thus, there are portions of the wall 62 which extend beyond the wall 66. A top end of the walls 62 have threads 72 for receiving yet another embodiment of the closure member according to this invention. As shown in FIG. 12, the wall 66 and the opening 68 extend outwardly from the cowl 61.

Figure 13:
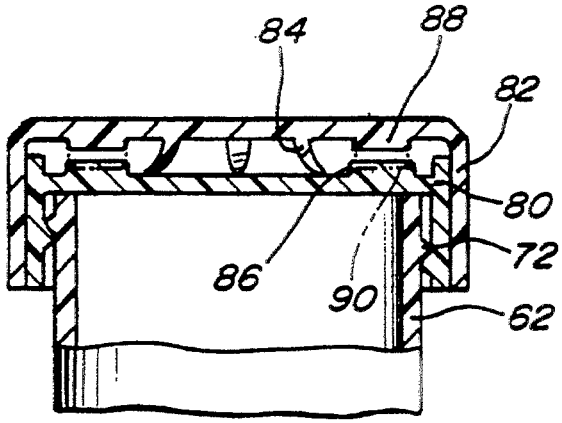
FIG. 13 is a view similar to FIG. 12, but showing yet another embodiment of this invention.

As shown in FIG. 13, a closure arrangement, including the cowl wall 62 having threads 72, receives a first cap portion 80 and a second cap portion 82. The inner peripheral wall of cap portion 82 is sized to be somewhat larger than the outer peripheral wall of cap portion 80, such that the two may freely rotate relative to each other, unless rotation is prevented by other structure. Other structure is provided to selectively cause rotation of cap position 82 to cause rotation of cap portion 80. As shown, a plurality of spring members 84 extend downwardly from an inner face of end wall 85 of cap portion 82. These spring members 84 are formed integrally with the cap portion 82 and generally bias the cap portion 82 to the position shown in FIG. 13. When one attempts to remove cap portion 82 with cap portions 80 and 82 in the illustrated position, cap portion 82 will rotate relative to cap portion 80. Spring members 84 will ratchet over block portions 86 formed on cap portion 80. Cap portion will not be removed. When one desires to remove the cap, one overcomes the force of the spring members 84 to force cap portion 82 in a direction toward the plug outlet. In this position, block portions 88 are moved from the solid position shown in FIG. 13 to the position shown in phantom at 90 wherein they are aligned with the block portions 86. Although only one of each member 84, 86, and 88 are shown, preferably there are plural of each. This structure is similar to known bottle closure structures. Now, when one rotates cap member 82 in this position, the block portions 88 engage the block portions 86 and cause cap portion 80 to rotate along therewith, and off wall 62.

Thus, several embodiments of this invention have been disclosed wherein a cap member must be forced toward a plug outlet and rotated to remove the cap member. This prevents easy access to the plug members. In addition, slots are formed through the cylindrical walls of cowls which encircle the plugs. These slots allow a cord to pass through the cowls, while a cap still encloses the plug. Further, although the invention is shown as a plug cover, it would have similar benefit in other covers, such as a switch cover, or a cover for other electrical device.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety cover for an electrical outlet comprising: a generally planar cover plate having at least one aperture formed therein for access to an electrical receptacle when said cover plate is installed on an electrical outlet or other device;

a cowl attached to said cover plate and including a wall extending about said aperture from said cover plate to an open end of said cowl, said wall having an outer edge at said open end of said cowl;

a slot formed in said wall extending from said outer edge toward said cover plate for receiving an electrical cord connected to an electrical plug;

a cap for closing said open end of said cowl; and releasable fastener means having a first fastener portion attached to an exterior surface of said wall and a cooperating second fastener portion attached to an inner surface of said cap, said first and second fastener portions cooperating to releasably retain said cap on said cowl and close said open end of said cowl to prevent access through said open end to an electrical receptacle and an electrical plug engaging the receptacle.

2. The safety cover according to claim 1 including a connector having one end attached to said cover plate and an opposite end attached to said cap.

3. The safety cover according to claim 2 wherein said connector is a flexible attachment strip attached to said cowl.

4. The safety cover according to claim 1 including a boss formed on said cap and a tool having a recess formed therein for engaging said boss and rotating said cap relative to said cowl.

5. The safety cover according to claim 1 including means for mounting said cover plate on an electrical outlet.

6. The safety cover according to claim 1 wherein said cover plate and said cap are formed from a non-conductive, non-flammable material.

7. The safety cover according to claim 1 wherein said first fastener portion is a tab having a ramp portion and a recess portion and said second fastener portion is a tab whereby said tab is engaged with said recess by pushing and twisting said cap to force said tab along said ramp and into said recess.

8. The safety cover according to claim 7 including a spring means attached to said cap for engaging said outer edge of said cowl.

9. The safety cover according to claim 1, wherein the cap includes a first cap portion, which is threadably received on said cowl, and a second cap portion which may selectively cause said first cap portion to rotate relative to said cowl, said second cap portion being biased to a position relative to said first cap portion, wherein said second cap portion may rotate freely relative to said first cap portion.

10. The safety cover according to claim 1 wherein said slot extends through said wall along an axis which is non-aligned with an axis into an electrical plug which is to receive the safety cover.

11. A safety cover for an electrical wall outlet comprising:

a generally planar cover plate having a pair of apertures formed therein for access to associated ones of a pair of electrical receptacles when said cover plate is installed on a duplex electrical outlet;

a pair of generally tubular cowls each having an annular wall extending from said cover plate to an open end of said cowl, said wall surrounding an associated one of said apertures;

a slot formed in each said wall extending from said outer edge toward said cover plate for receiving an electrical cord connected to an electrical plug engaging the receptacle;

a pair of caps for closing said open ends of said cowls; and a releasable fastener means having a first fastener portion attached to an exterior surface of said cowl and a second fastener portion attached to an inner surface of said cap, said first and second fastener portions cooperating to retain each said cap on said cowl to close said open end of said cowl to prevent access through said aperture to an electrical receptacle.

12. The safety cover according to claim 11 including a pair of flexible connectors each having one end attached to said cover plate and an opposite end attached to an associated one of said caps.

13. The safety cover according to claim 11 wherein said cover plate includes at least one mounting aperture for receiving a fastener whereby the fastener engages an electrical outlet for mounting said cover plate.

14. The safety cover according to claim 11 wherein each said cap includes a boss having a predetermined shape for cooperating with a tool whereby a twisting force is applied to rotate said cap relative to said associated cowl.

15. The safety cover according to claim 11 wherein said cap includes a spring means attached to an inner surface of said cap for engaging said outer edge of said cowl and biasing said cap away from said cover plate.

16. The safety cover according to claim 15 wherein said spring means collapses under pressure applied to said cap in longitudinal direction whereby rotational movement of said cap in opposite directions relative to said cover plate engages and disengages said first and second fastener portions.

17. The safety cover according to claim 11, wherein the cap includes a first cap portion, which is threadably received on said cowl, and a second cap portion which may selectively cause said first cap portion to rotate relative to said cowl, said second cap portion being biased to a position relative to said first cap portion, wherein said second cap portion may rotate freely relative to said first cap portion.

18. The safety cover according to claim 11, wherein said slot extends through said wall along an axis which is non-aligned with an axis into an electrical plug which is to receive the safety cover.

19. A safety cover for an electrical wall outlet comprising:

a generally planar cover plate having an opening formed therein for access to a pair of electrical receptacles when said cover plate is installed on a duplex electrical outlet;

a pair of generally tubular cowls each having an annular wall extending from said cover plate to an open end of said cowl, said walls surrounding said opening;

a slot formed in each said wall extending from said outer edge toward said cover plate for receiving an electrical cord connected to an electrical plug engaging the receptacle;

a pair of caps for closing said open ends of said cowls; and a releasable fastener means having a first fastener portion attached to an exterior surface of said cowl and a second fastener portion attached to an inner surface of said cap, said first and second fastener portions cooperating to reasonably retain each said cap on said cowl to close said open end of said cowl to prevent access through said opening to an electrical receptacle.

20. The safety cover according to claim 19 wherein the cap must be moved toward the electrical plug and rotated to remove the cap from the cowl.

* * * * *